US007905743B2

(12) United States Patent
Foratier et al.

(10) Patent No.: US 7,905,743 B2
(45) Date of Patent: Mar. 15, 2011

(54) QUICK-FIT CONNECTION SOCKET FOR MULTI-CONDUCTOR CABLE

(75) Inventors: Nathalie Foratier, Saint Antoine l'Abbaye (FR); Jean-Marc Jaouen, La Sône (FR); Didier Revol, Chatte (FR); Vincent Laroche, Saint-Marcellin (FR)

(73) Assignees: LeGrand France, Limoges (FR); LeGrand SNC, Limoges (FR)

( * ) Notice: Subject to any disclaimer, the term of this patent is extended or adjusted under 35 U.S.C. 154(b) by 0 days.

(21) Appl. No.: 12/519,541

(22) PCT Filed: Nov. 20, 2007

(86) PCT No.: PCT/FR2007/001905

§ 371 (c)(1),
(2), (4) Date: Jan. 28, 2010

(87) PCT Pub. No.: WO2008/081087

PCT Pub. Date: Jul. 10, 2008

(65) Prior Publication Data

US 2010/0190372 A1 Jul. 29, 2010

(30) Foreign Application Priority Data

Dec. 22, 2006 (FR) ..... 06 11324

(51) Int. Cl.
*H01R 11/20* (2006.01)
*H01R 4/24* (2006.01)
*H01R 4/26* (2006.01)

(52) U.S. Cl. ..... 439/412

(58) Field of Classification Search ..... 439/411–413, 439/416, 418, 395–396, 387, 389, 391, 393
See application file for complete search history.

(56) References Cited

U.S. PATENT DOCUMENTS

| | | | | |
|---|---|---|---|---|
| 4,960,389 | A * | 10/1990 | Frantz et al. | 439/404 |
| 4,969,839 | A | 11/1990 | Nilsson | 439/395 |
| 5,752,849 | A | 5/1998 | Orlando | 439/412 |
| 6,752,647 | B1 | 6/2004 | Lin | 439/412 |

FOREIGN PATENT DOCUMENTS

EP 0980117 A2 2/2000

OTHER PUBLICATIONS

International Search Report, application No. PCT/FR2007/001905 dated Jun. 9, 2008.
Written Opinion of the International Searching Authority, application No. PCT/FR2007/001905.

* cited by examiner

*Primary Examiner* — Javaid Nasri
(74) *Attorney, Agent, or Firm* — Seyfarth Shaw LLP

(57) ABSTRACT

The invention relates to a socket to be mounted on a multi-conductor cable and including a removable comb (1) having a central channel (5) extending therethrough, a connection terminal block (2), and a screw (3) and nut (4) assembling device. According to the invention, the screw (3) is fixedly mounted on the comb (1) for axial translation therewith and capable of rotation relative to the comb about the axis (X) of the socket, the terminal block (2) including two columns (22) that prevent the rotation of the comb about the axis (X) and in which helical notches (41) are formed that define a portion at least of the nut (4).

11 Claims, 7 Drawing Sheets

QUICK-FIT CONNECTION SOCKET FOR MULTI-CONDUCTOR CABLE

CROSS-REFERENCE TO RELATED APPLICATIONS

This application is a 371 filing of International application no. PCT/FR2007/001905 filed Nov. 20, 2007.

FIELD

The invention relates, generally, to the field of connections, and in particularly that of connection accessories for computer applications.

More specifically, the invention relates to a socket to be mounted on a multi-conductor cable and comprising a removable comb, a connection terminal block and clamping means, the comb having a central channel extending therethrough to allow the cable to pass along a longitudinal axis and displaying, on a first front face, notches arranged about the central channel and wherein each is designed to hold a corresponding insulated conductor of the cable, the terminal block being suitable for receiving a multi-conductor removable plug, and comprising, on a second front face adjacent to the first front face in the mounted configuration of the socket, self-stripping electric contacts each of which is suitable for receiving and stripping, during the socket mounting phase, a corresponding insulated conductor of the cable by means of a relative movement of said contact and said insulated conductor held in a notch of the comb, and the clamping means comprising a screw and nut assembling device with the central channel extending therethrough and performing said relative movement in the mounting phase.

A socket of this type is particularly known to those skilled in the art through the U.S. Pat. No. 5,752,849.

Despite the benefit thereof, the socket described in this prior patent is relatively difficult to use, the prevent invention being specifically intended to propose a socket which is much easier and quicker to use.

SUMMARY

To this end, the socket according to the invention, also complying with the generic definition given in the above preamble, is essentially characterized in that the screw is fixedly mounted on the comb for axial translation therewith and capable of free rotation relative to the comb about the axis, in that the terminal block comprises at least two columns projecting axially from the second front face, in that at least a portion of the nut is defined by helical notches formed in the columns, and in that said socket comprises a rotation stop preventing the rotation of the comb about the axis and for example wherein at least one portion is defined by one of the columns.

Preferentially, the notches open onto lateral faces of the comb, free and adjacent to the first front face.

The screw advantageously comprises at least two helical ramps having an angular development at least equal to one turn, and inserted respectively in helical notches, in the socket mounting phase, by means of a fastening movement of the screw.

This screw may also comprise gripping raised surfaces arranged on either side of the axis and projecting axially opposite the first front face.

The columns preferentially have respective helical end faces, parallel with the notches respectively formed in said columns, helping define the nut, and serving as a support for respective inner faces of the helical ramps of the screw in a socket dismounting phase.

It is also advisable to envisage that the socket comprises a polarizing slot arranged on at least one of the first and second front faces and only allowing the assembly of the comb and the terminal block in a single relative angular position about the axis.

The housing serving as a receptacle for the removable plug may consist of an axial housing of the terminal block, arranged opposite the second front face.

In one industrially optimized embodiment, the comb may comprise a cylindrical shaft whereon the screw is force-fitted axially, and having a radially elastic edge trapping the screw along the longitudinal axis, at least one of the members consisting of the comb, terminal block and screw possibly also being produced at least partially by molding a thermoplastic material.

The screw may also have a collar provided with one or more radial raised surfaces, each radial raised surface being capable of cooperating with the edge of a corresponding column to enable reversible fastening of the screw with respect to said column at the end of the mounting phase.

The invention is particularly suitable for producing a socket complying with the standard ISO IEC 11 801.

BRIEF DESCRIPTION OF THE DRAWINGS

Other features and advantages of the invention will emerge clearly from the description hereinafter, which is given as an indication and is in no way limitative, with reference to the appended figures, wherein.

DETAILED DESCRIPTION

Figure 1:
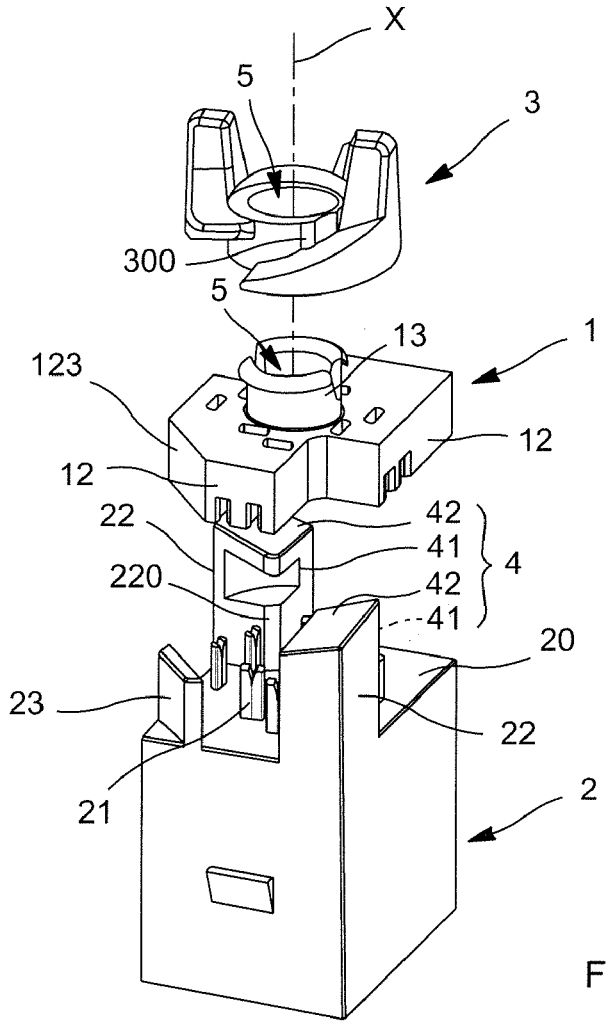
FIG. 1 is an exploded perspective view of a socket according to the invention.

As mentioned above, the invention relates to a socket to be mounted on a multi-conductor cable K and complying for example with the standard ISO IEC 11 801, said socket comprising at least one removable comb 1, a terminal block 2 and clamping means such as 3 and 4.

The comb 1 has a central channel 5 extending therethrough to allow the cable K to pass along a longitudinal axis X of the socket.

Said comb comprises, on a front face 10, notches 11 arranged about the central channel 5, each notch 11 being designed to hold a corresponding insulated conductor C of the cable K.

Figure 8:
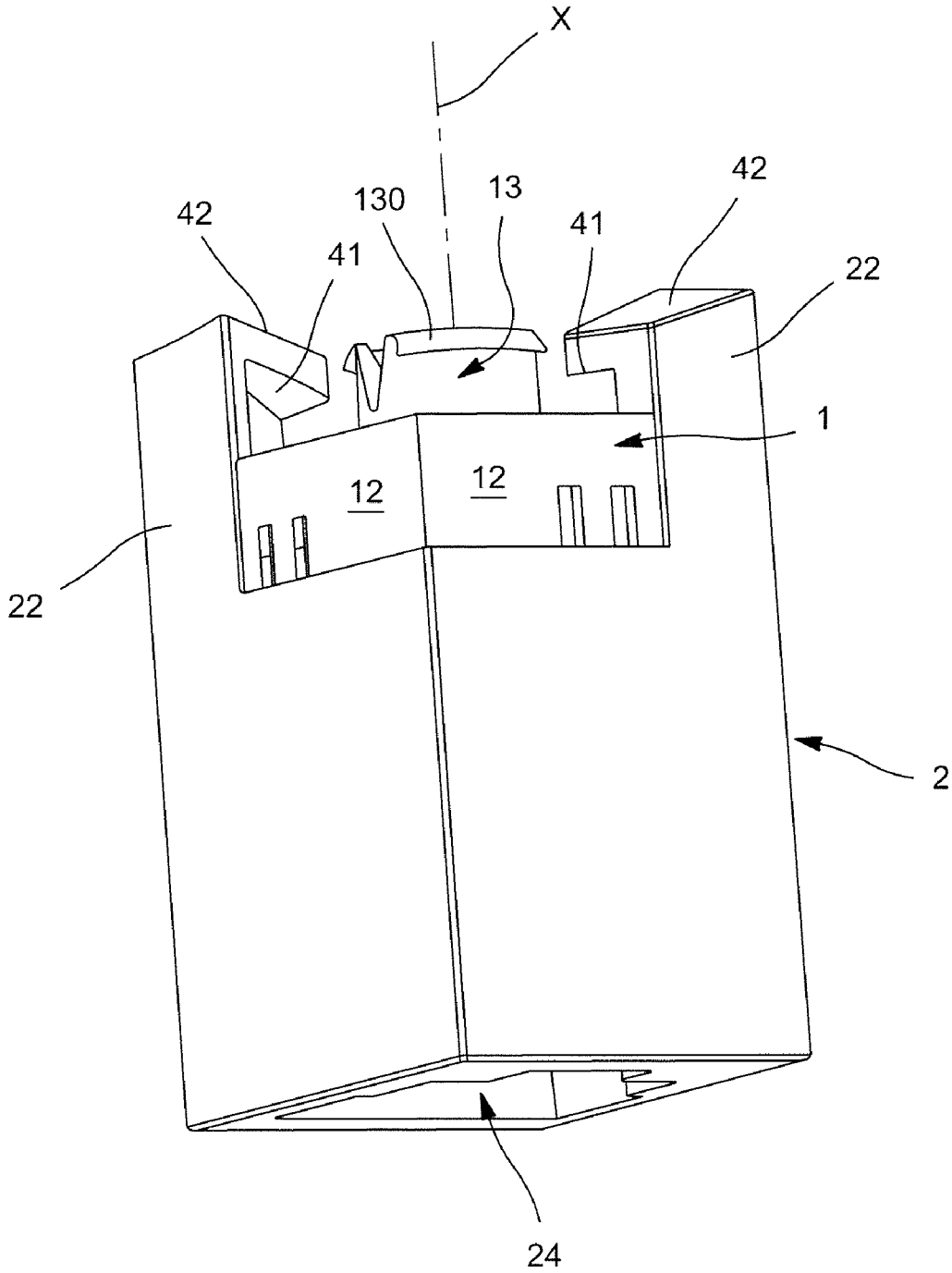
FIG. 8 is a larger-scale perspective view of a subassembly used in the socket in FIG. 1.
Figure 9:
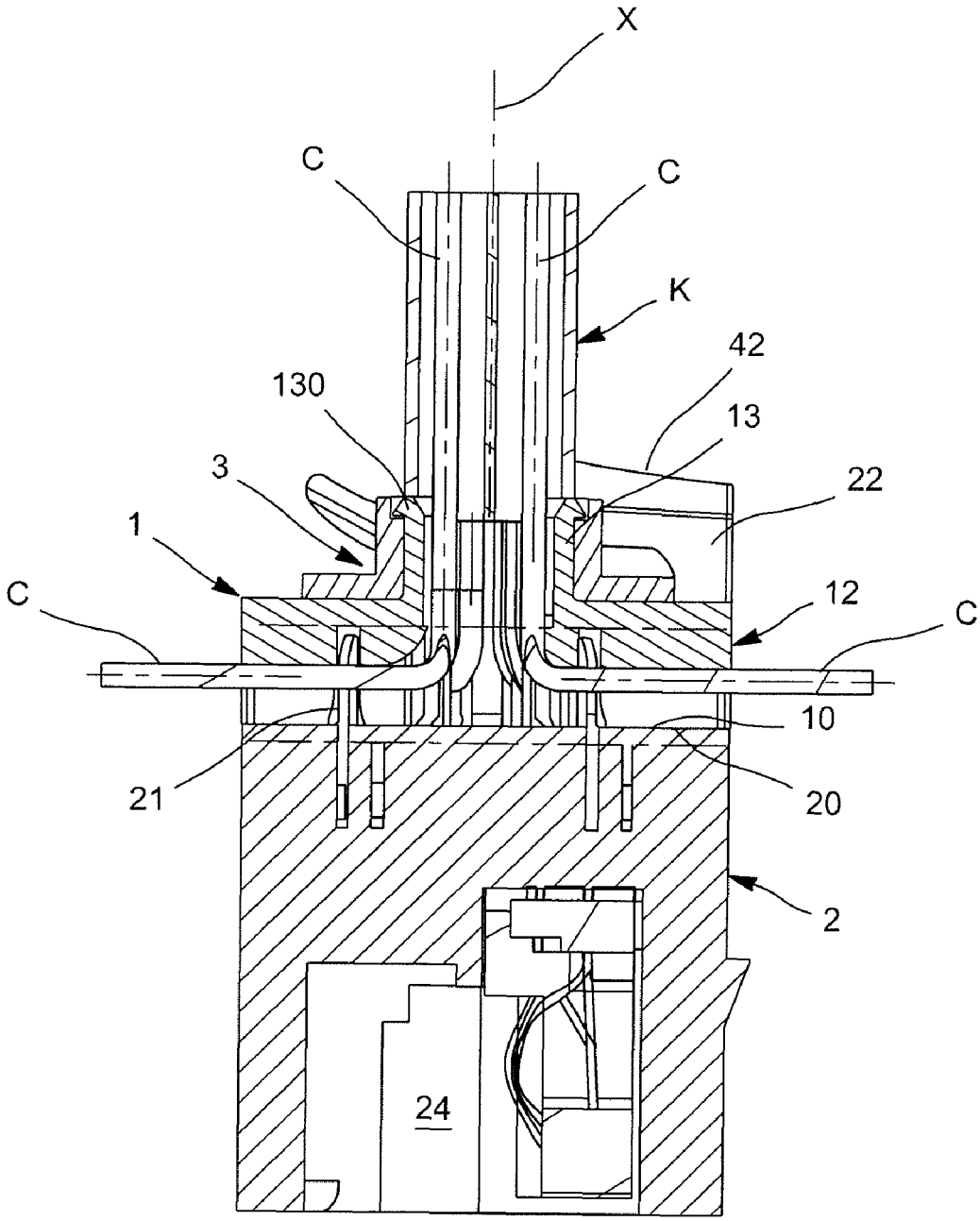
FIG. 9 is a larger-scale axial section view of the socket illustrated in FIG. 1, equipped with a cable and observed just after the mounting phase, before the sectioning of the insulated conductors.

The terminal block 2 is suitable for receiving a multi-conductor removable plug and comprises for example for this purpose an axial housing 24 serving as a receptacle for such a plug (FIGS. 8 and 9).

Said terminal block 2 comprises, opposite the axial housing 24, a front face 20 which, in the mounted configuration of the socket, is arranged facing the front face 10 of the comb 1 and immediately adjacent to said face 10.

The terminal block 2 comprises, on the front face 20 self-stripping electric contacts 21 each of which is suitable for receiving a corresponding insulated conductor C of the cable K.

Each of the contacts 21 comprises, in a known manner, a pair of metal blades to be able to strip the corresponding insulated conductor C, which is held in a notch 11 of the comb 1, by means of a relative movement of said contact 21 and of said insulated conductor C, performed during a socket mounting phase.

The clamping means essentially consist of an assembling device with the central channel 5 extending therethrough, said assembling device comprising a screw 3 and a nut 4, and particularly serving to perform, during the mounting phase, the relative movement of each contact 21 and of each corresponding insulated conductor C.

In a socket according to the invention, the screw 3 is fixedly mounted on the comb 1 for axial translation therewith and capable of rotation relative to the comb 1 about the axis X.

For example (FIG. 8), the comb 1 comprises a cylindrical shaft 13 whereon the screw 3 is force-fitted, said shaft having a radially elastic edge 130 which traps the screw along the longitudinal axis X.

Furthermore, the terminal block 2 comprise several columns, for example two columns 22, which project axially from the front face 20 of said terminal block 2 and which advantageously serve at least two functions.

Firstly, these columns 22 comprise helical notches 41, formed radially in said columns, and which, together, define or help define the nut 4.

Secondly, one or more of the columns 22 preferentially form a rotation stop, capable of preventing the rotation of the comb 1 about the axis X.

By means of this arrangement, the socket before mounting only comprises two sub-assemblies, each of which may be held in the operator's hand, the assembly of these two subassemblies being easy to perform without needing to take specific measures to prevent the rotation of the comb 1 relative to the terminal block 2.

Figure 6:
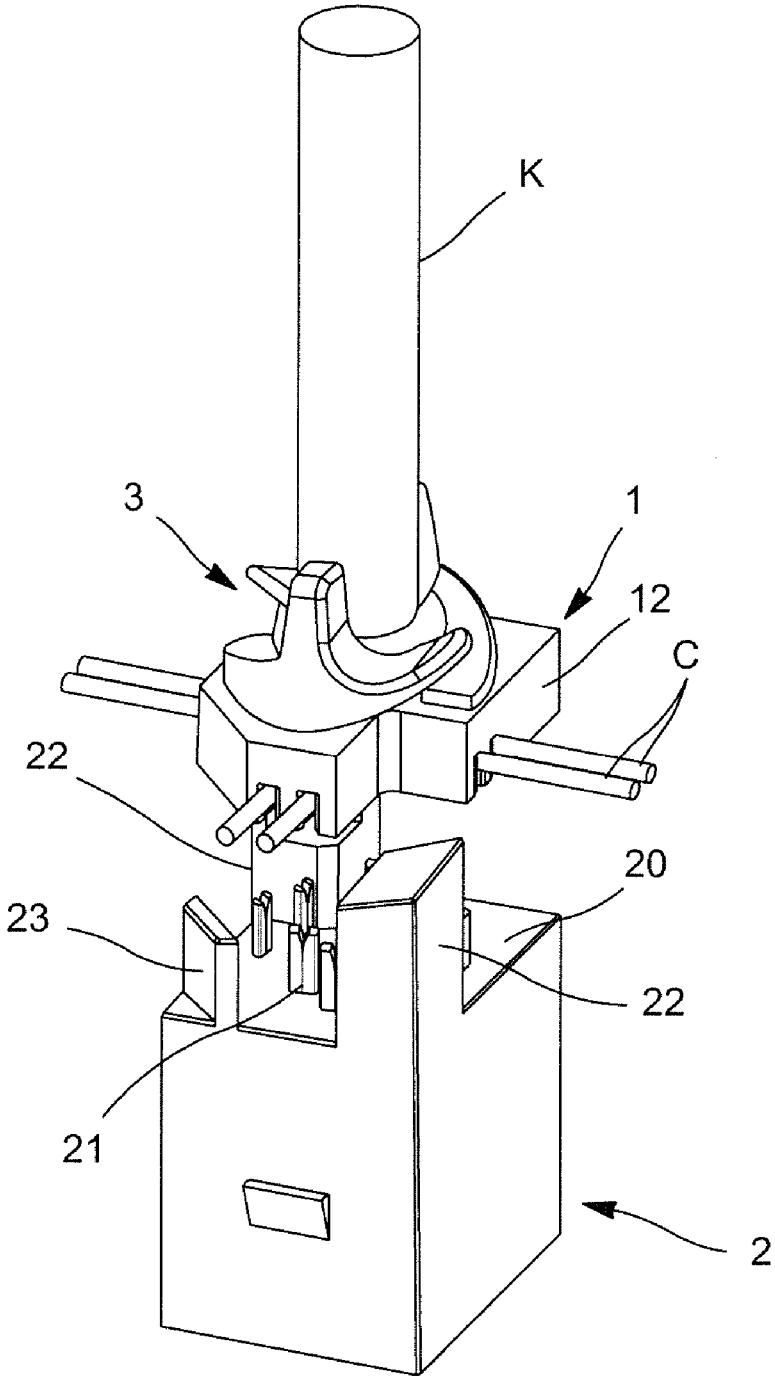
FIG. 6 is a perspective view of the socket illustrated in FIG. 1, equipped with a cable and observed just before a mounting phase.
Figure 7:
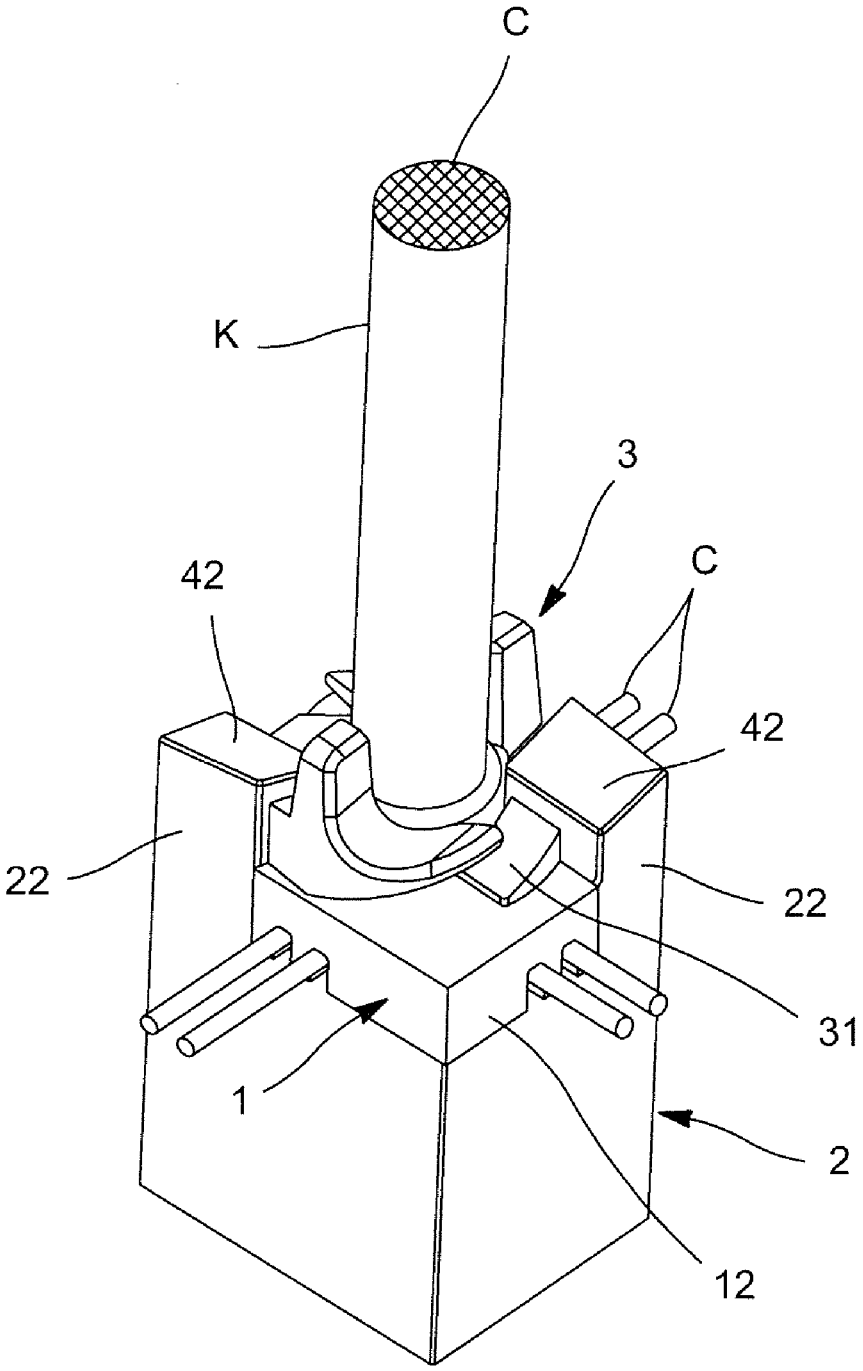
FIG. 7 is a perspective view of the socket illustrated in FIG. 1, equipped with a cable and observed just after the mounting phase, before the sectioning of the insulated conductors.

As shown in FIGS. 6 and 8 in particular, the notches 11 open onto free faces 12 of the comb 1, which consist of lateral faces, adjacent to the front face 10 of the comb 1 and perpendicular to said face 10.

By means of this arrangement, the insulated conductors C projecting from said faces 12 may be readily sectioned after mounting the socket.

Figure 2:
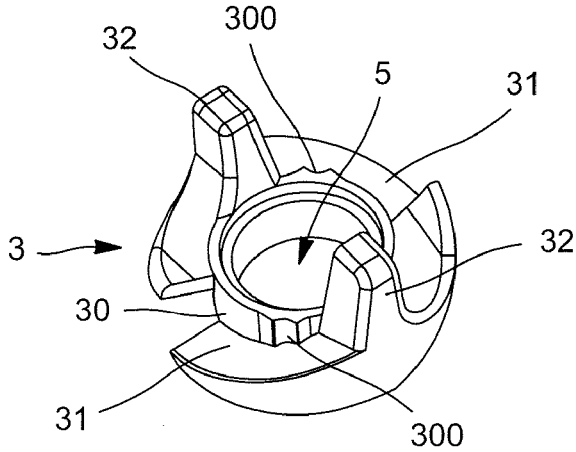
FIG. 2 is a larger-scale perspective view of the screw used in the socket in FIG. 1.
Figure 3:
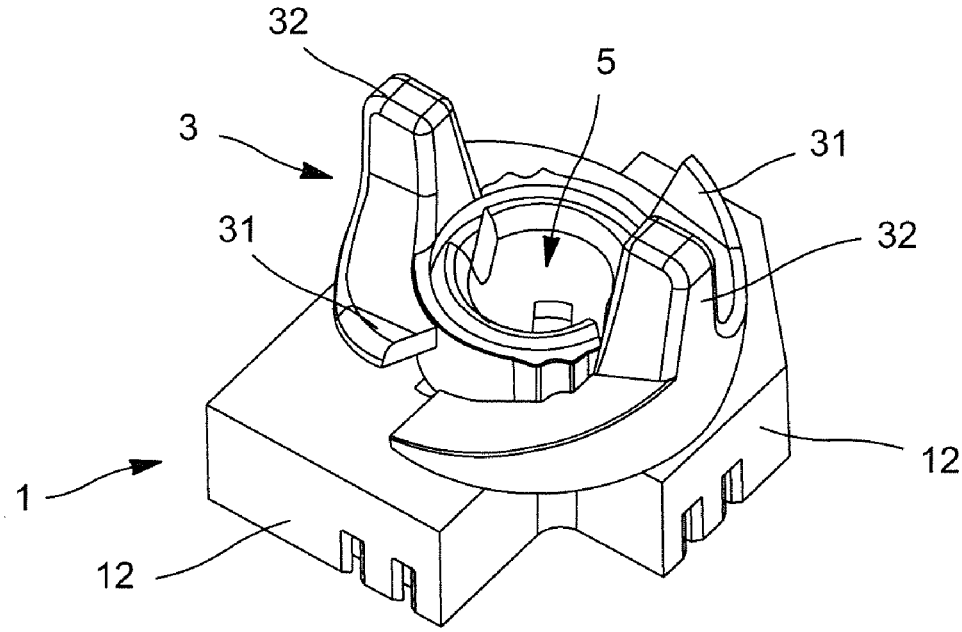
FIG. 3 is a larger-scale perspective view of a subassembly used in the socket in FIG. 1.
Figure 4:
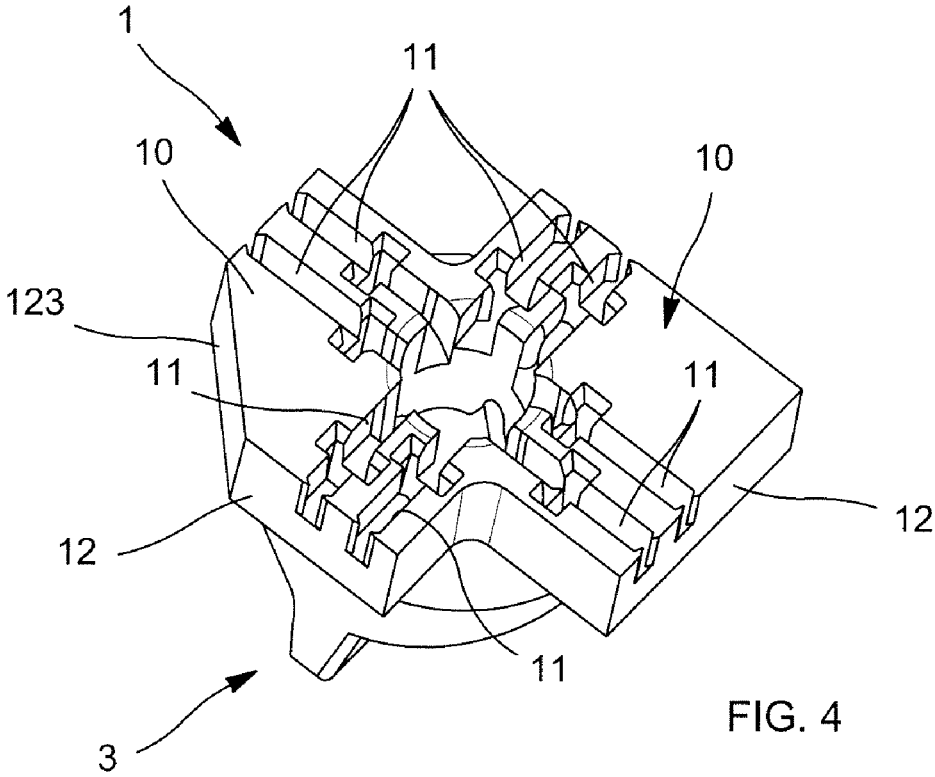
FIG. 4 is a perspective view of the subassembly illustrated in FIG. 3, observed under another incidence.
Figure 5:
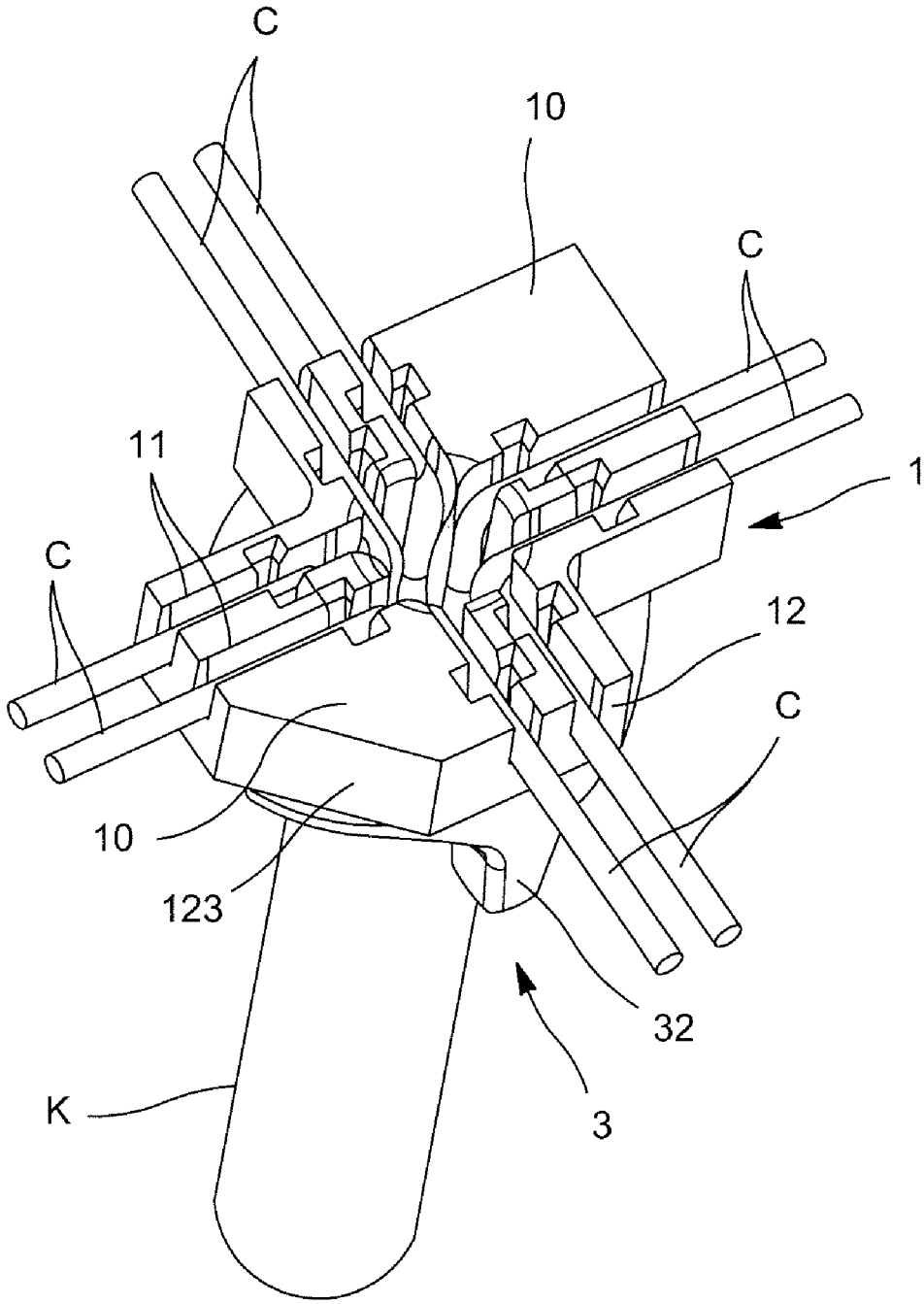
FIG. 5 is a perspective view of the subassembly illustrated in FIG. 4, observed after inserting a cable.

As clearly demonstrated in FIGS. 2 and 3, the screw 3 comprises several helical ramps 31 having a limited angular development, for example two helical ramps each of which has an angular development of approximately one half-turn, i.e. 180 degrees.

Each of these ramps 31 is formed to be able to be inserted, in the socket mounting phase and by means of a rotation movement of the screw 3, in a corresponding helical notch 41 of a column 22.

The application of a rotational torque on the screw 3 is facilitated by providing on said screw gripping raised surfaces 32 arranged on either side of the X axis and projecting axially in a direction moving away from the front face 10.

As shown in FIG. 2, the screw 3 may also comprise a collar 30 provided with one or more radial raised surfaces 300, each raised surface 300 being capable of cooperating with the edge 220 (FIG. 1) of a corresponding column to enable reversible locking of the screw 3 with respect to said column at the end of the mounting phase.

Preferentially, a portion of the nut 4 is also defined by the end faces 42 of the columns 22.

Said end faces 42, which are helical and parallel with the notches 41, serve as supports, in a socket dismounting phase, for the respective inner faces of the helical ramps 31 of the screw 3, thus facilitating dismounting considerably.

To prevent any error during the mounting of the socket, a polarizing slot 23 may be arranged on the front face 20 of the terminal block 2, said polarizing slot cooperating for example with a specific lateral face 123 of the comb 1 and only allowing the assembly of the comb 1 and the terminal block 2 in a single relative angular position about the axis X.

In an industrially optimized embodiment of the invention, the comb 1, the terminal block 2, the screw 3, or at least one of said members may be produced at least partially by molding a thermoplastic material.

The invention claimed is:

1. A socket to be mounted on a multi-conductor cable and comprising at least one removable comb, a connection terminal block and at least one assembling device, the comb having a central channel extending therethrough to allow the cable to pass along a longitudinal axis and displaying, on a first front face, notches arranged about the central channel and wherein each is designed to hold a corresponding insulated conductor of the cable, the terminal block being suitable for receiving a multi-conductor removable plug, and comprising, on a second front face adjacent to the first front face in the mounted configuration of the socket, self-stripping electric contacts each of which is suitable for receiving and stripping, during the socket mounting phase, a corresponding insulated conductor of the cable by a relative movement of said contact and said insulated conductor held in a notch of the comb, and the at least one assembling device comprising a screw and nut assembling device with the central channel extending therethrough and performing said relative movement in the mounting phase, characterized in that the screw is fixedly mounted on the comb for axial translation therewith and capable of free rotation relative to the comb about the axis, in that the terminal block comprises at least two columns projecting axially from the second front face, in that at least a portion of the nut is defined by helical notches formed in the columns, and in that said socket comprises a rotation stop preventing the rotation of the comb about the axis and for example wherein at least one portion is defined by one of the columns.

2. The socket according to claim 1, characterized in that the notches open onto lateral faces of the comb, free and adjacent to the first front face.

3. The socket according to claim 1, characterized in that the screw comprises at least two helical ramps having an angular development at least equal to one turn, and inserted respectively in helical notches, in the socket mounting phase, by a fastening movement of the screw.

4. The socket according to claim 3, characterized in that the columns have respective helical end faces, parallel with the notches respectively formed in said columns, helping define the nut, and serving as a support for respective inner faces of the helical ramps of the screw in a socket dismounting phase.

5. The socket according to claim 1, characterized in that the screw comprises gripping raised surfaces arranged on either side of the axis and projecting axially opposite the first front face.

6. The socket according to claim 1, characterized in that it comprises a polarizing slot arranged on at least one of the first and second front faces and only allowing the assembly of the comb and the terminal block in a single relative angular position about the axis.

7. The socket according to claim 1, characterized in that the terminal block comprises, opposite the second front face, an axial housing serving as a receptacle for the removable plug.

8. The socket according to claim 1, characterized in that the comb comprises a cylindrical shaft whereon the screw is force-fitted axially, and having a radially elastic edge trapping the screw along the longitudinal axis.

9. The socket according to claim 1, characterized in that the screw has a collar provided with one or more radial raised surfaces, each radial raised surface being capable of cooperating with an edge of a corresponding column to enable reversible fastening of the screw with respect to said column at the end of the mounting phase.

10. The socket according to claim 1, characterized in that at least one of the comb, terminal block and screw is also produced at least partially by molding a thermoplastic material.

11. The socket according to claim 1, characterized in that it complies with an ISO IEC 11 801 standard.

* * * * *